US009107469B2

(12) United States Patent
Brunsvig et al.

(10) Patent No.: US 9,107,469 B2
(45) Date of Patent: Aug. 18, 2015

(54) SNOWSHOE WITH INTEGRATED ARTICULATING LINK

(71) Applicant: SNOWMOTION AS, Oslo (NO)

(72) Inventors: Christian Brunsvig, Oslo (NO); Fredrik Wenstøp, Oslo (NO); Kristian Wenstøp, Oslo (NO); Liam Thomas Frank Woolley, Oslo (NO)

(73) Assignee: SNOWMOTION AS, Oslo (NO)

( * ) Notice: Subject to any disclaimer, the term of this patent is extended or adjusted under 35 U.S.C. 154(b) by 243 days.

(21) Appl. No.: 13/690,843

(22) Filed: Nov. 30, 2012

(65) Prior Publication Data

US 2014/0041258 A1 Feb. 13, 2014

(30) Foreign Application Priority Data

Aug. 13, 2012 (NO) ..... 20120892

(51) Int. Cl.
*A43B 5/04* (2006.01)
*A63C 13/00* (2006.01)

(52) U.S. Cl.
CPC ..... *A43B 5/04* (2013.01); *A63C 13/006* (2013.01)

(58) Field of Classification Search
CPC ..... A63C 13/00
USPC ..... 36/122–125
See application file for complete search history.

(56) References Cited

U.S. PATENT DOCUMENTS

| | | | | |
|---|---|---|---|---|
| 3,885,327 | A * | 5/1975 | Maki | 36/125 |
| 4,271,609 | A | 6/1981 | Merrifield | |
| 5,720,120 | A * | 2/1998 | Smith | 36/124 |
| 6,052,922 | A | 4/2000 | Bleck | |
| 6,163,984 | A * | 12/2000 | Faber et al. | 36/125 |
| 6,178,666 | B1 | 1/2001 | Kiniry et al. | |
| 7,461,467 | B2 * | 12/2008 | Park et al. | 36/7.6 |
| 2003/0126764 | A1 | 7/2003 | Emerson et al. | |
| 2008/0141564 | A1 | 6/2008 | Matthews et al. | |
| 2012/0117827 | A1 | 5/2012 | Grande et al. | |

FOREIGN PATENT DOCUMENTS

| | | | |
|---|---|---|---|
| FR | 2 901 711 | A1 | 12/2007 |
| WO | WO 95/06502 | A1 | 3/1995 |

* cited by examiner

*Primary Examiner* — Clinton T Ostrup
*Assistant Examiner* — Anne M Kozak
(74) *Attorney, Agent, or Firm* — Birch, Stewart, Kolasch & Birch, LLP

(57) ABSTRACT

A snowshoe with an integrated articulating link is provided, where a surface support structure and a foot connector plate are connected by a multi-axial articulating link. The surface support structure, the foot connector plate and the articulating link constitute a structural unit, a mono-construction. The multi-axial tilt motion in the articulating link is achieved by extension and compression in the material structure. The extension and compression in the material structure is controlled by one or more corrugations in the arms.

11 Claims, 4 Drawing Sheets

SNOWSHOE WITH INTEGRATED ARTICULATING LINK

Figure 1:
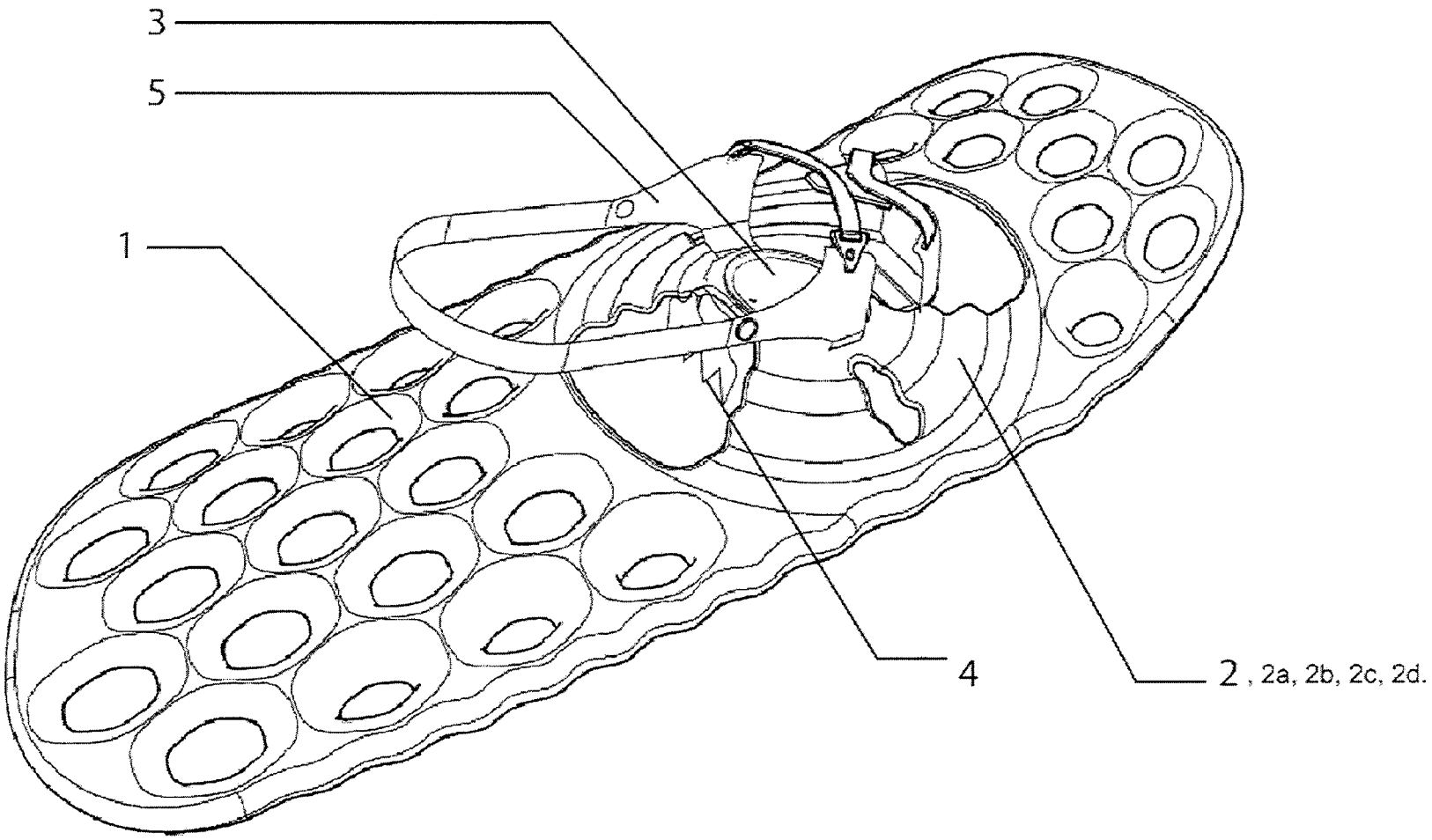

The invention is a snowshoe, relating to an outfit for motion where there is a need of increased support surface area on substrates as snow, particularly the invention relates to plastic moulded snowshoes or snowshoes made in composite material.

TECHNICAL BACKGROUND AND PRIOR ART

Snowshoes are developed to increase the carrying capacity to a person moving at surfaces with reduced strength, usually snow. Snowshoes may also be used in sand. Snowshoes are attached under the user's feet and constitutes a structure with higher basal area than the foot, both in the lateral- and lengthwise direction. In the moving direction the snowshoe extends beyond the foot both in the front and at the rear to form a balanced weight distribution during walking. Presently existing snowshoes are generally compounded of 3 main elements; support area structure, articulating link, and binding. The support area structure often consists of a cloth spanned over a frame.

An example of such a snowshoe is the snowshoe called Tubbs Mountaineer. Tubbs has a U.S. Pat. No. 6,178,666 "Molded snowshoe" wherein the support area structure and the binding are connected by a single axial cylinder link.

Mono constructions render possible production methods such as injection moulded, and compression moulded snowshoes, possibly of materials as polymer and composite. This reduces the number of components and increase the robustness. Most of the presently existing snowshoes pivot about one single axis mechanically bounded to the support area structure of the snowshoe. Such a rotation axis allows, besides an possible slack within the binding, limited adaptation for irregularities and inclinations of the terrain. A simple athwart directed axis of rotation linked to a larger support area structure increases the strain on the user's foot, especially to the ankle joint and/or the knees, by increased lateral torque. A loose connection between the foot and the support area structure provides little control of the placement of the snowshoe relative to the foot. Variants also exist provided with elastic bands attached to the snowshoes support area structure as well as an alternative to shafts and combinations of such. Previously suggested are multi-axial links for snowshoes constituted by elastic bands replacing the mono-axial, otherwise stiff link. An example is the patent US 2008/0141564 A1 Matthews et al., which have a single axial rotational link combined with elastics bands to the right and the left end out to the frame to allow multi axial movement.

A considerable disadvantage of the existing snowshoes is that they consist of a high number of components. The components are of various size and material composition. A high number of components of variable robustness means that the reliability to the complete snowshoe is reduced, in that a snowshoe with one single failing detail may lead to the snowshoe in practice becomes more or less useless, and in that the user becomes stuck in the snow or forced to considerably slow down. For a hunter, rescue personnel or a soldier this may have vital negative consequences. A high amount of components means that unnecessary material is used only for joining parts together by links, nails or screws and nuts, sleeves, lockers etc., ergo the weight becomes unnecessarily high. Snowshoes as such are by their own heavy in whenin use for walking, and should be as light as possible.

SHORT SUMMARY OF THE INVENTION

A substantial improvement of existing snowshoes is represented by the invention which is a snowshoe comprising an extensively long and broad surface support structure (1) and a generally round footplate (3) with a binding (5), wherein the footplate (3) and the surface support structure (1) are mutually connected by an articulating link (2), characterized in that the footplate (3) covers an underside of a part of a wearer's foot's fore portion and is surrounded by the surface support structure (1), the footplate (3) being spaced from the surface support structure (1), and that the articulating link (2) comprising two or more resilient, preferably flexible and resilient radial bands (2*a, b, c, d*) between the footplate (3) and the surface support structure (1), and wherein the bands comprise corrugated portions (10), so as for allowing the surface support structure (1) to move under increasing torsion resistance at least in the length-and lateral direction of the foot.

Further advantageous features are given in the attached claims.

The outset of the present invention is to reduce the aforementioned negative effects and disadvantages of conventional snowshoe, especially the snowshoes comprising mono axial links. The other point is to increase the robustness by reducing the amount of unnecessary parts and joints. This is achieved by introducing a multi axial link, and by integrating the supporting surface structure, the link and the footplate in one mono structure.

Advantages by the Invention

The snowshoe comprising the integrated link according to the invention, improves the ergonomics, adaption to the substrate, and controls the snowshoe's position relative to the foot. This results in a more natural way of walking for the user, at the same time as irregularities in the terrain is absorbed by the snowshoe link and not by the user's foot. Tests show that a snowshoe like this is more precise to use and provides for new applications. The snowshoe according to the invention has integrated components and thus comprises, less components than in the prior art and will weigh less.

The snowshoe with integrated link reduces the risk of critical defects by reduction of unnecessary parts.

Embodiments of the Invention

The invention relates in this manner a snowshoe with an integrated link comprising a surface support structure (1), an articulating link 2, and a footplate 3. This is obtained according to the invention in that the surface support structure (1), the articulating link 2, and the footplate 3 are connected in a structural unit, a mono-structure. The freedom of movement for the articulating link is achieved by elongation and compression resulting from the geometry of the link. The geometry of the link (2) involves one or more pleats that expands the materials mobility between the surface support structure (1) and the footplate (3) and thus provides mobility to the user. By pleats is meant any geometrical elongation of the material surface between the surface support structure (1) and the footplate 3. The link of the snowshoe has a freedom of movement around three axis and the start position of the link is controlled. By start position is meant the angle between the support structure 1 and the footplate 3 in its idle position. The angle may be between 0-60 degrees relative to the horizontal plane, preferably between 5-45 degrees and definitely best between 10-25 degrees.

An example of a snowshoe according to the invention will be further described below with reference to the attached drawings. A snowshoe for a right and a left foot is not similar since the snowshoe is mirrored around a central axis. The figure show a snowshoe for the right foot. A snowshoe for the left foot will be a mirror image of this snowshoe.

FIG. 1. shows a snowshoe according to the invention in a perspective view.

Figure 2:
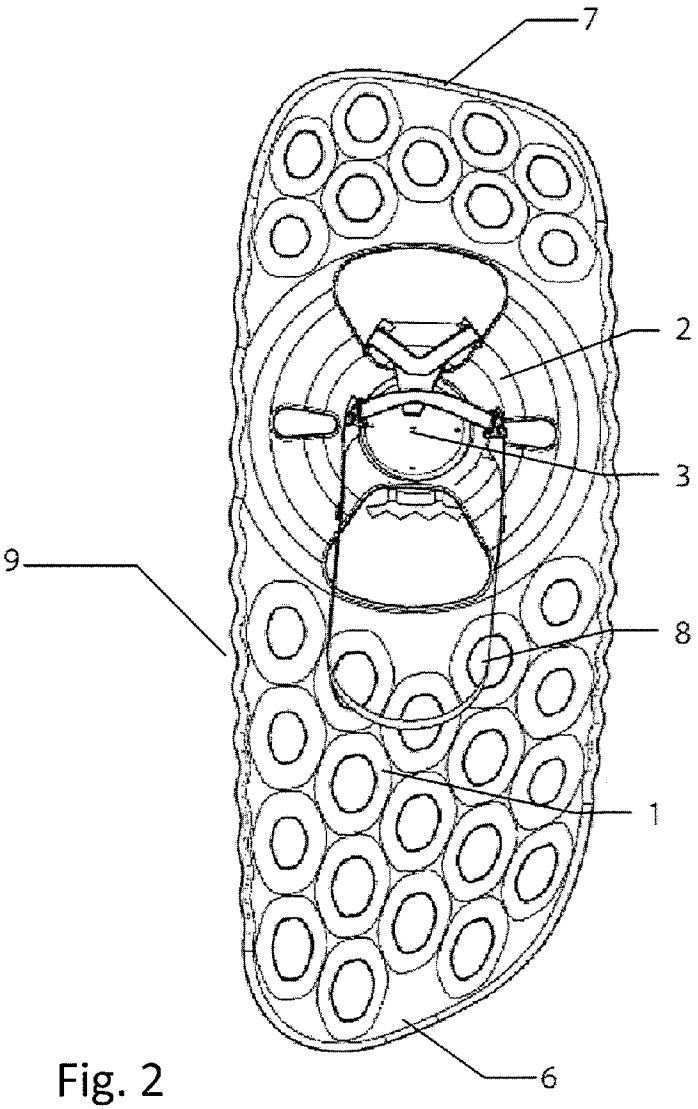

FIG. 2. shows the snowshoe in FIG. 1, seen from above.

Figure 3:
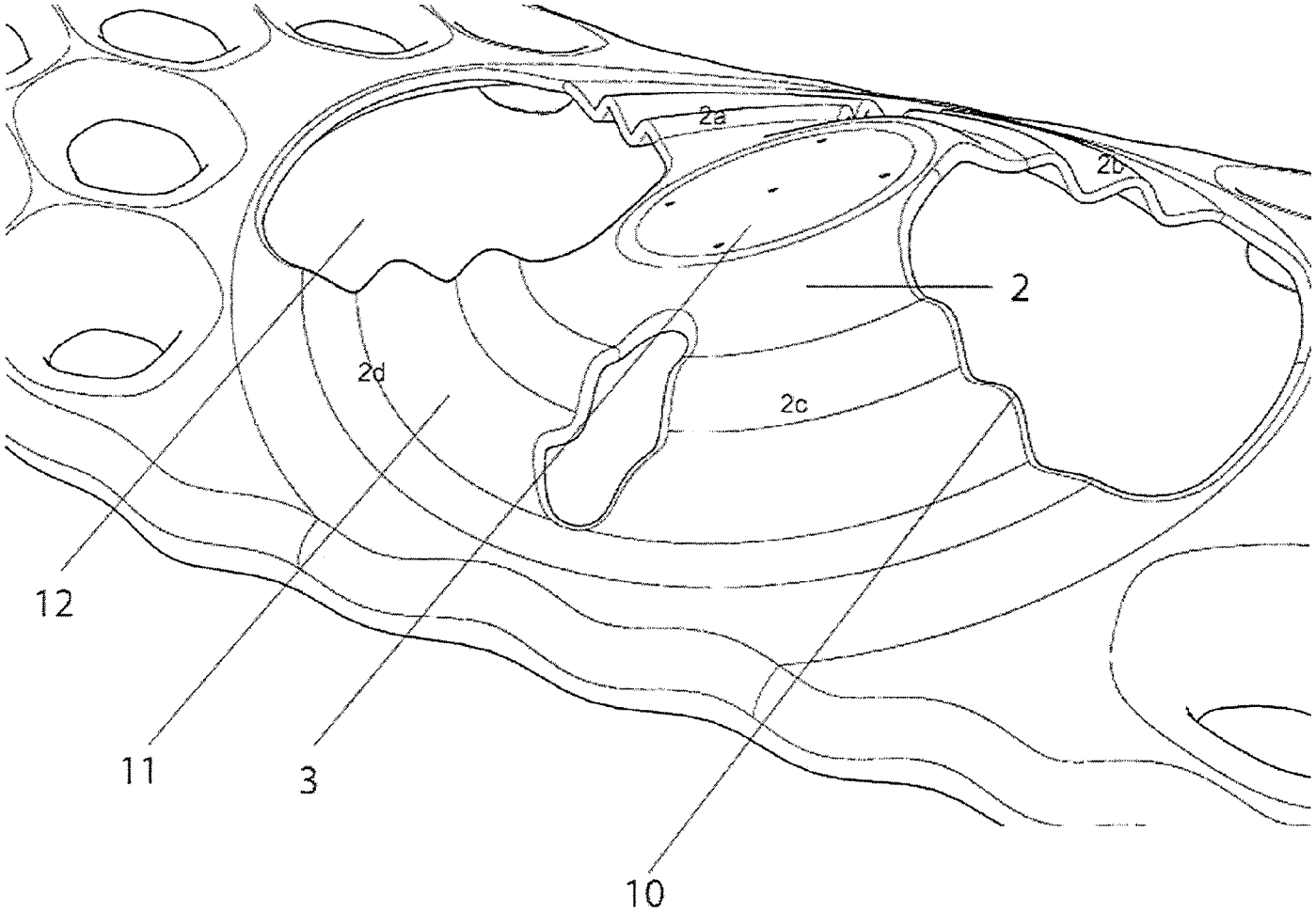

FIG. 3. shows the snowshoe in FIG. 1, somewhat enlarged relative to FIG. 1-2 and FIG. 4-5, seen in perspective.

Figure 4:
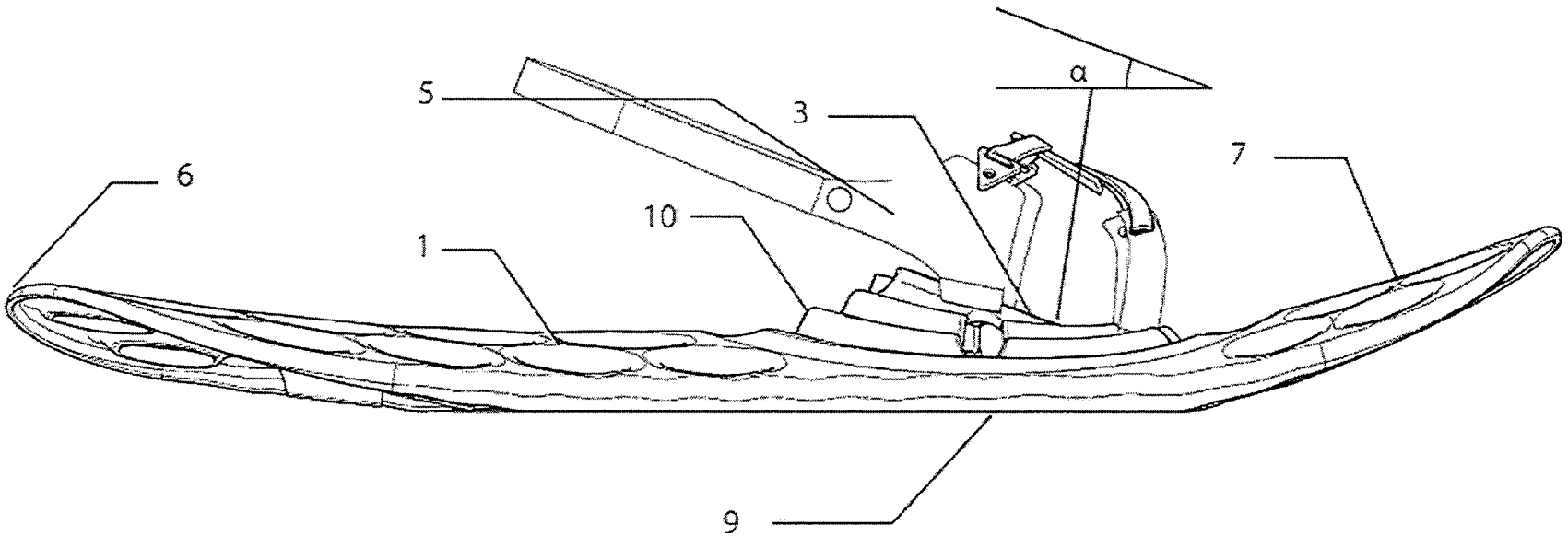

FIG. 4. shows the snowshoe in FIG. 1 seen towards the right side.

Figure 5:
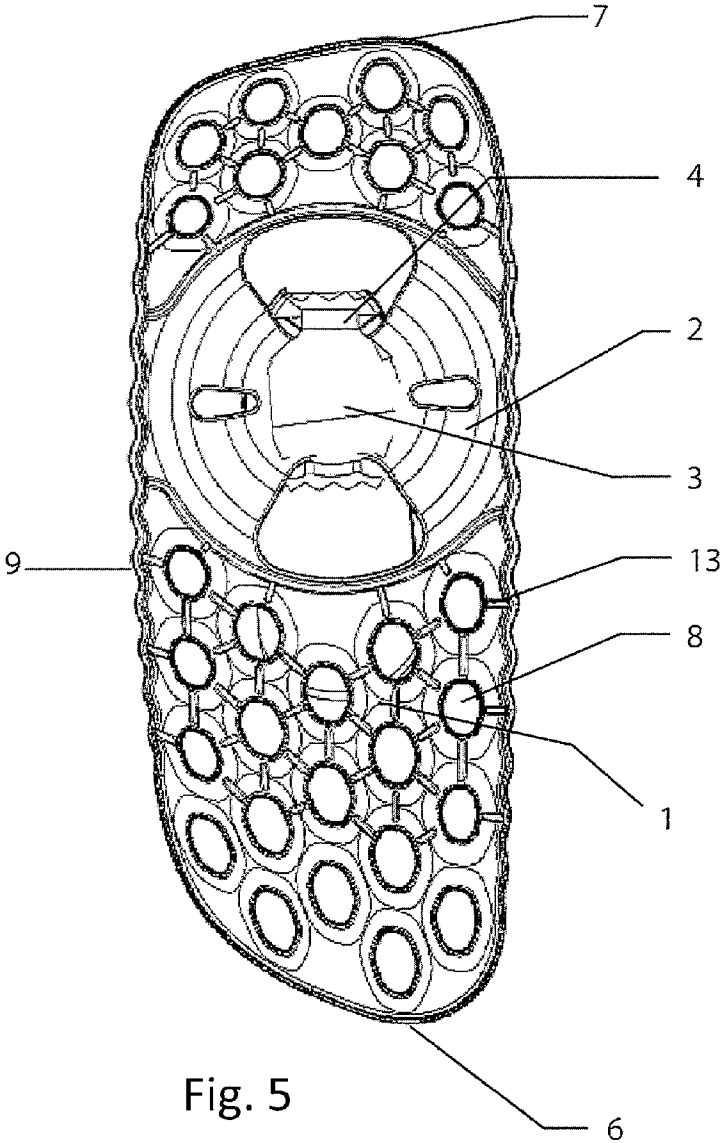

FIG. 5 shows the snowshoe in FIG. 1, seen from below.

The snowshoe with integrated link according to the invention is shown in the drawing, FIG. 1, shows the snowshoe with integrated link with the surface support structure 1, connected to the articulating link 2, and the footplate 3 in a mono-construction. The binding 5 and the arrangement for grip 4 is fixed to the footplate by known principles. The snowshoe is manufactured in a plastic material that can withstand several cycles. Thermoplastic Polyester elastomer is an example of such material.

FIG. 2 shows a snowshoe according to the invention from above. The snowshoe has an outer contour where the right and the left snowshoe are similar to each other, but as mirror image of each other. The tail portion 6 of the snowshoe is rounded and preferably the tail portion 6 of the snowshoe is concave and arc shaped in the longitudinal direction as shown in FIGS. 2 and 4. This results in that the right and the left snowshoe may be inscribed into a circle or an oval form. This contributes to a more compact working radius for the user thus the snowshoe may be placed close to each other and the distance between the feet is optimized. The snowshoe with integrated link may also comprise two symmetrical snowshoes. The surface support structure is perforated without significantly reducing the carrying capacity. This is made by polygonal holes 8 spread out over the support structure 1. The holes run from the lowest point of the snowshoe up in a funnel-shape to the top of the surface support structure 1. It is possible to vary the sizes of the perforations as well, preferably between 20 and 2 cm in diameter, absolutely best between 2.0 and 4.5 cm. It is also possible to skip the perforations completely, but they do contribute to reduce the total weight. The lateral edge 9 is wavy shaped seen from above. The lateral edge comprises one or more waves with an amplitude between 0.1 and 10.0 cm, preferably between 0.4 and 0.1 cm. The waves have a wavelength of between 20 and 1 cm and absolutely best between 2.0 and 4.5 cm. The wavy lateral edge 9 contributes to increasing the gripping effect of the snowshoe according to the invention, but might be replaced by straight edges.

The link 2 is rotated between 0 and 30 degrees clockwise (for the right snowshoe, and opposite for the left snowshoe) relative to a symmetrical central line in the motion direction, preferably between 0 and 10 degrees and definitely best between 2 and 3 degrees clockwise in the direction of movement. This contributes to that the user's feet may have a natural starting position at the same time as the snowshoes' length direction is parallel in the direction of motion. The link may be parallel to the direction of motion as well.

FIG. 3 shows the link enlarged. The link 2 gives a multi-axial motion between the surface support structure 1 and the footplate 3. This is ensured by the geometry of the link constituted as pleats in the material. The link has an oval contour seen from above, but may also be inscribed in a circle or a polygon. The link 2 comprises one or more arms connecting the surface support structure and the footplate 3. The arms 11 comprise one or more pleats 10. The pleats 10 increase the length of the cross section that the forces will be distributed to in the link 2. A longer cross section makes it require less force to move the footplate 3 relative to the support structure 1. The pleats 10 in the link 2 are shaped based on sine curves with an amplitude between 0.1 and 5.0 cm preferably between 0.1 cm and 1.0 cm and absolutely best between 0.2 and 0.4 cm. It may also be employed other wave structures with a wavelength between 0.1 cm and 12.0 cm preferably between 1.0 and 5.0 cm and absolutely best between 2.0 and 3.0 cm. The arms 11 comprised by the link 2, are shaped with 1 or more circles, preferably between 3 and 5 circles. The pleats in the link may be parallel or radial. It is also possible to have varying amplitudes and periods in the link to control the motion in the link by graded amplitude and period in the link. Low amplitude and period will give less motion, larger amplitude and period gives more motion related to exposed force. The link 2 comprises one or more perforations 12.

The perforations 12 have a rounded shape, but may also have a polygonal shape. The perforations 12 contribute to increase the multi-axial movement between the footplate 3 and the surface support structure 1. This by reducing the volume of the material. The perforation may vary in number and shape or removed totally.

The FIG. 4 shows the right snowshoe seen from the right. The lateral edge 9 is horizontal towards the ground plane under the mid part of the surface support structure 1. The front 7 is slightly elevated relative to the base plane to enable a rolling motion for the user and to prevent the tip to dig into the snow. The tail portion 6 is also elevated relative to the ground level, but is less elevated than the front portion. The lateral edge 9 decreases height-wise towards the tail portion to the end of the tail portion. The footplate 3 is set in an initial position. This contributes to elevate the front 7 when the user's sole of the foot approaches the horizontal position. By the initial position the angle between the footplate 3 and the horizontal plane is meant. This angle $\alpha$ may be between 0-70 degrees related to the horizontal plane, preferably between 5 and 45 degrees and definitely best between 19 and 21 degrees. The angle $\alpha$ between the footplate 3 and the horizontal plane renders the link 2 having a higher vertical cross section towards the tale portion 6 than towards the front 7.

FIG. 5 shows the underside of the snowshoe according to the invention. The right snowshoe is shown in FIG. 5. The underside of the snowshoe according to the invention is designed with the purpose to maintain stiffness and friction against the base surface. The perforations 8 are tied together by ribs 13. The ribs and the perforations constitute a hexagonal pattern in a horizontal cross section. The ribs and the perforations may as well constitute other polygonal or linear pattern in the horizontal cross section. It is also possible to achieve stiffness in the direction of motion and the base surface by reducing the number of perforations and ribs. Friction and stiffness may be achieved by metal bars comprising friction teeth to ensure gripping and stiffness in the direction of movement. It is possible to combine metal bars with friction teeth and perforations bound together by ribs as well.

As it appears from especially FIG. 1 and FIG. 4 the surface support structure, the link and the footplate are integrated in a mono-structure. As an alternative to design the snowshoe with an integrated link as a unit structure, those may be separate parts that are assembled in any way to form a mono-structure. However, a uniform structure may provide the benefit that the total weight will be reduced compared to the use of separate parts. A mono-structure also gives the distinct benefit when it comes to robustness and production time.

The snowshoe with integrated link according to the invention may be made of any suitable materials, including such materials as mentioned in the introduction.

1 Surface support structure
2 Articulating link
3 footplate
4 Arrangement for gripping
5 Binding
6 Tail portion
7 Front
8 Perforations
9 Lateral edge
10 Pleats
11 Articulating link arm
12 Perforation
13 Ribs

The invention claimed is:

1. A snowshoe comprising a long and broad surface support structure and a generally round footplate with a binding, said footplate and said surface support structure mutually connected by an articulating link, wherein said footplate covers an underside of a part of a wearer's foot's fore portion and is surrounded by said surface support structure, said articulating link comprising two or more resilient radial bands between said footplate and said surface support structure, said two or more resilient radial bands being connected in a corrugated configuration, wherein said two or more resilient radial bands are connected in a manner such that each of said two or more resilient radial bands provides an increment in elevation from the surface support structure up to the footplate, said two or more resilient radial bands being configured to allow said surface support structure to tilt under increasing torsion resistance in a longitudinal direction of said wearer's foot and in a lateral direction of said wearer's foot, and wherein one single material piece forms said surface support structure, said footplate and said articulating link comprising said two or more resilient radial bands.

2. The snowshoe of claim 1, wherein said two or more resilient radial bands are flexible and elastic.

3. The snowshoe according to claim 2, wherein said footplate in an unloaded state forms an angle of between 5 and 45 degrees with said surface support structure.

4. The snowshoe of claim 3, wherein said footplate forms an angle of between 19 and 21 degrees with said surface support structure.

5. The snowshoe according to claim 1, wherein said footplate in an unloaded state forms an angle of between 5 and 45 degrees with said surface support structure.

6. The snowshoe of claim 5, wherein said footplate forms an angle of between 19 and 21 degrees with said surface support structure.

7. The snowshoe according to claim 1, wherein said footplate in an unloaded state forms and angle of between 5 and 45 degrees with said surface support structure.

8. The snowshoe of claim 7, wherein said footplate forms an angle of between 19 and 21 degrees with said surface support structure.

9. The snowshoe according to claim 1, wherein said two or more resilient radial bands extend more in a lateral direction than in a length direction from said footplate relative to said wearer's foot, so as for said footplate's torsional resistance in said wearer's foot's lateral direction becomes higher than said footplate's torsional resistance in said wearer's foot's length direction, so as for achieving a natural human gait with torsion stability in the transverse direction for said wearer's foot.

10. The snowshoe according to claim 1, wherein said footplate comprises a downwardly directed crampon which is brought into contact with a substrate upon loading said footplate.

11. The snowshoe according to claim 1, wherein a number of said two or more resilient radial bands is four.

* * * * *